US005493082A

United States Patent [19]

Bloch et al.

[11] Patent Number: 5,493,082

[45] Date of Patent: Feb. 20, 1996

[54] ELASTOMERIC SWITCH FOR ELECTRONIC DEVICES

[75] Inventors: Kenneth A. Bloch; Donald J. Thomas, both of San Diego; Steven E. Smart, Ramona, all of Calif.

[73] Assignee: Hughes Aircraft Company, Los Angeles, Calif.

[21] Appl. No.: 289,021

[22] Filed: Aug. 9, 1994

[51] Int. Cl.[6] ..... H01H 15/00; H01H 1/02

[52] U.S. Cl. ..... 200/16 A; 200/5 A; 200/292; 200/511

[58] Field of Search ..... 200/1 R, 5 A, 200/5 R, 512, 517, 511, 16 R, 16 A, 292; 338/2, 99

[56] References Cited

U.S. PATENT DOCUMENTS

| | | | |
|---|---|---|---|
| 3,860,771 | 1/1975 | Lynn et al. | 200/5 A |
| 3,879,586 | 4/1975 | DuRocher et al. | 200/5 A |
| 4,164,634 | 8/1979 | Gilano | 200/5 A |
| 4,754,546 | 7/1988 | Lee et al. | 29/877 |
| 4,896,069 | 1/1990 | Rosenberg et al. | 200/600 X |
| 4,955,818 | 9/1990 | Strange et al. | 439/66 |
| 5,293,017 | 3/1994 | Bartlett | 200/511 |

*Primary Examiner*—J. R. Scott

*Attorney, Agent, or Firm*—Gordon R. Lindeen, III; Wanda K. Denson-Low

[57] ABSTRACT

There is provided an elastomeric switching device for use with electrical circuits, such as those on a printed circuit board. The elastomeric switching device comprises an elastomeric pad constructed from a plurality of parallel strips of conductive material between layers of non-conductive or insulating material together with a moveable conductive contact which is aligned with the elastomeric pad. The elastomeric pad is predisposed in contact with the circuits on the printed circuit board. The moveable conductive contact establishes electrical connections between the affected circuits via the conductive strips of the elastomeric pad. The proper alignment and orientation of the elastomeric pad and moveable conductive contact relative to the circuits is maintained by the structural and mechanical features of a housing.

18 Claims, 3 Drawing Sheets

ELASTOMERIC SWITCH FOR ELECTRONIC DEVICES

BACKGROUND OF THE INVENTION

The present invention generally relates to a switching device for electronic circuits and, more particularly, is concerned with a small, low cost and highly reliable switch which utilizes elastomer elements to connect, disconnect or transfer the current between one or more circuits within an electronic device.

Because of the importance of switches to the operation of many electronic circuits and electronic devices, there have been a large number of technological approaches taken to the design of switches. These technological approaches range from simple rotary switches and other electro-mechanical switching devices to the more complex optical switching and plasma switching devices. The traditional, and more common, approaches involved the use of mechanical devices or solid state electrical components to connect, disconnect or transfer the current between one or more circuits within an electronic device.

A related and somewhat modern approach to the design of switching devices involves the use of conductive rubber or elastomers as part of an electro-mechanical switching mechanism. The conductive rubber switching mechanisms use generally non-conductive rubber material which becomes electrically conductive when subjected to mechanical forces such as compression or tension.

There also exist many varieties of elastomer membrane switches and other pushbutton switches or keyboard switches which utilize conductive elastomers. One such example is an elastomer dome keypad switch which includes a layer of elastomeric material having domes located at predetermined positions. Located in the center of the domes is a piece of conducting elastomer. Collapsing a dome causes the conducting elastomer to contact switch elements formed on the surface of an underlying printed wire board.

As the size of many electronic devices and circuitry diminishes, the design considerations of a switching device for use with the smaller electronic components becomes more of a challenge. The switching devices used in small electronic devices such as telephones, receivers, transmitters, detectors, and controllers, should preferably demonstrate a high reliability, a relatively low cost, improved maintainability characteristics, and efficient use of space both for the switching device and the associated connections. A preferable switch would also be simple in design which can be easily incorporated into the assembly process of the host electronic device.

SUMMARY OF THE INVENTION

The present invention satisfactorily addresses the need for a small, low cost and highly reliable switch for an electronic device. Specifically, the present invention is directed to an elastomeric switching device for electrical circuits which comprises: an elastomeric pad; a moveable conductive contact that selectively removed from or makes contact with the elastomeric pad in response to an externally applied force, and a housing. The elastomeric pad further comprises a plurality of parallel layers or strips of conductive material between layers of non-conductive or insulating material. Some of the parallel conductive strips of the elastomeric pad are predisposed in direct contact with the affected circuits. This is preferably accomplished by aligning many of the very thin conductive strips with gold or other conductive traces on a printed circuit board. The moveable conductive contact is also aligned with the elastomeric pad and, in response to an externally applied force, establishes redundant connections between the affected circuits via the elastomeric pad. The proper alignment and orientation of the elastomeric pad and moveable conductive contact relative to the circuits is maintained by the structural and mechanical features of the housing.

An important feature and advantage offered by the present invention includes the presence of a significant redundancy of electrical contacts between the constituent elements. For example, since each of the conductive strips in the elastomeric pad are only about 4 mils or less in size, there will exist a large number of redundant contacts between the elastomeric pad and the standard gold traces of a printed circuit board. Because each the conductive strips are electrically isolated from one another, each conductive strip represents an independent connection with the printed circuit board. In the same manner, the conductive strips of the elastomeric pad also establish independent connections with the conductive contact of the moveable connector.

The present invention is a relatively small and simple device which can be constructed from commercially available elements. The elastomer pad is a relatively inexpensive item and can be easily replaced during many maintenance operations. The utilization of the elastomeric switch does not require any soldering or other labor intensive manufacturing procedures. Moreover, the elastomeric switch is easily adaptable to many different applications.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 5*a* depicts the elastomeric switch in an open condition with the moveable connector in a nonconductive position with respect to the elastomeric pad. FIG. 5*b* depicts the elastomeric switch in a closed condition with the moveable connector establishing an electrically conductive connection across the elastomeric pad.

DETAILED DESCRIPTION OF THE INVENTION

The following description is of the best mode presently contemplated for carrying out the invention. This description is not to be taken in a limiting sense, but a mode merely for the purpose of describing the general principles of the invention. The scope of the invention should be determined with reference to the claims.

Figure 1:
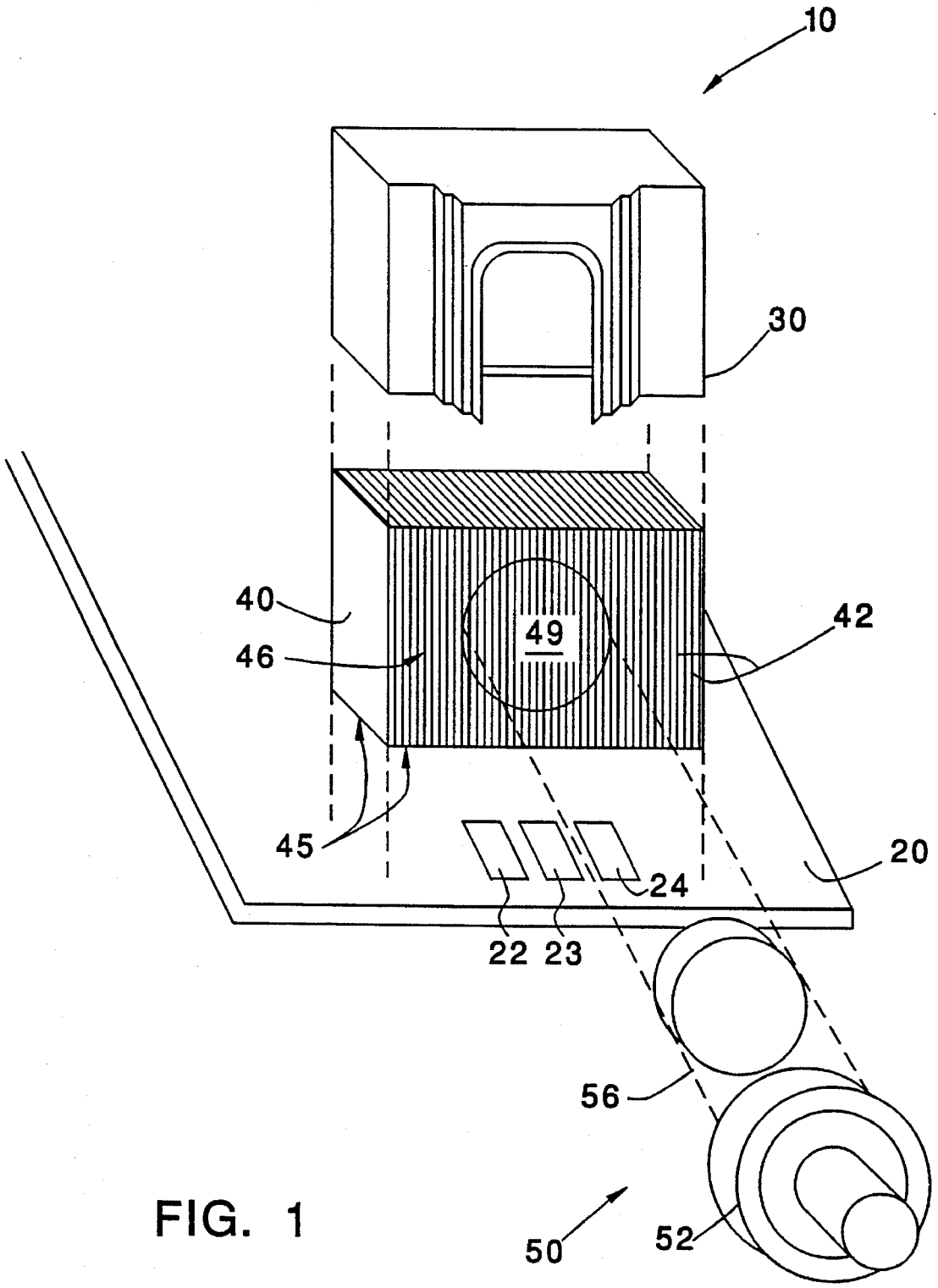
FIG. 1 is an exploded perspective view of an embodiment of the elastomeric switch for connecting and disconnecting the electronic circuitry of a printed circuit board.

Referring now to the drawings, and particularly to FIG. 1, there is shown a perspective view of an embodiment of the elastomeric switch 10 which is adapted for connecting, disconnecting or transferring the current between one or more circuits within an electronic device. In the shown embodiment, the circuits (not shown to be connected or disconnected are generally disposed on a single printed circuit board 20. A plurality of traces 22,23,24 which lead to and are connected with the individual circuits on the printed circuit board 20 are preferably disposed proximate one another such that the elastomeric switch 10 can establish a connection or alternatively terminate a connection between the traces 22,23,24. The preferred embodiment of the elastomeric switch 10 comprises a housing 30, an elastomeric pad 40, and a moveable connector 50, all of which are generally disposed on or proximate to the traces 22,23,24 of the printed circuit board 20. The housing 30, as shown, is adapted for maintaining the elastomeric pad 40 in constant contact with printed circuit board traces 22, 23, 24.

Figure 2:
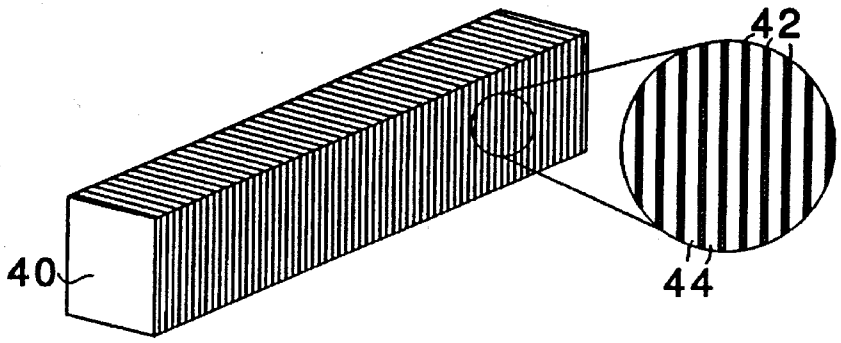
FIG. 2 is an enlarged sectional view of the elastomeric pad showing layers of conductive material sandwiched between the layers of non-conductive or insulating material.

As best seen in and FIG. 2, the elastomeric pad 40 is comprised of a plurality of layers or strips of conductive material 42 sandwiched between the layers of non-conductive or insulating material 44. As evident in FIG. 1, the conductive strips 42 or layers should preferably be exposed on at least two outer surfaces of the elastomeric pad 40. One of the exposed surfaces 45 of the elastomeric pad is disposed in direct contact with the traces 22,23,24 on the printed circuit board 20. A second exposed surface 46 is adapted to receive the moveable connector 50 in a manner that will establish a connection between two or more parallel conductive strips 42. The moveable connector 50, which includes a conductive contact 56 and a flexural diaphragm shell 52, is aligned with the elastomeric pad 40 such that the parallel conductive strips 42 which are in the target area 49 of the moveable element 50 are the same parallel conductive strips 42 which are in contact with the traces 22, 23, 24 on the printed circuit board 20 thus establishing a connection between the circuits.

The elastomeric pad 40 is versatile and cost effective. The elastomeric pad 40 is inherently resistant to vibration and shock. Because of the mechanical properties, an elastomeric pad 40 typically establishes a good electrical contact with other components of the switch. The elastomeric pad 40 is easy to handle, easy to replace, and eliminates the need for any hardwiring or soldering which are often needed with conventional switches.

Referring back to FIG. 2, the conductive strips 42 used in the elastomeric pad 40 are preferably made from conductive silicone rubber. The material is actually made conductive by impregnating a silicone rubber base with either carbon or metal particles such as silver flakes. These carbon or metal layers can be as thin as 2.5 mils. Alternatively, metalized paths of copper, nickel, and/or gold, can be formed on a silicone rubber base to make the conductive strips. The metalized paths typically have widths from about 2.0 to 4.0 mils. The silicone rubber base not only holds the metalized paths in position, but also keeps the metalized paths in electrical contact with the other elements of the elastomeric switch 10.

The non-conductive material 44 used in the elastomeric pad is also made from silicone rubber. A particular advantage of the silicone rubber is that the electrical properties and mechanical characteristics of silicone rubber remain essentially constant over time. Silicone rubber does not tend to become sticky, brittle or develop cracks. Extreme temperatures and harsh environmental conditions also do not substantially degrade the mechanical or electrical properties of the non-conductive silicone rubber. In fact, silicone rubber shows little or no degradation when exposed to ultraviolet radiation, excessive humidity, and salt water contamination. The resistivity of the non-conductive silicone rubber is also very high which eliminates the possibility of metal migration from the conductive strips into the dielectric material, eventually producing a short circuit and thus, an inoperable switch.

A preferred elastomeric pad 40 will adhere to generally the same specifications as elastomeric connectors such as the type offered by Elastomeric Technologies, Inc. of Hatboro, Pa., and described in U.S. Pat. No. 4,955,818 issued on Sep. 11, 1990 to Strange et al., incorporated herein by reference.

There are available from commercial suppliers, such as Elastomeric Technologies, several different variations of the elastomeric pad 40 which can be adapted for use in the elastomeric switch 10. At least two surfaces of the elastomeric pad 40 should have exposed conductive strips 42 or layers. The elastomeric pad 40 may have as many as all four surfaces that have exposed alternating layers of conductive strips 42 and non-conductive material 44. Other variations of the elastomeric pad may include a configuration where only two opposite surfaces or only two adjacent surfaces of the elastomeric pad 40 have exposed alternating layers of conductive strips 42 and non-conductive material 44. However, the dimensions of the elastomeric pad 40 and the number of surfaces having exposed conductive strips 42 can be tailored to meet the specific application for which the elastomeric switch 10 is used.

Figure 3:
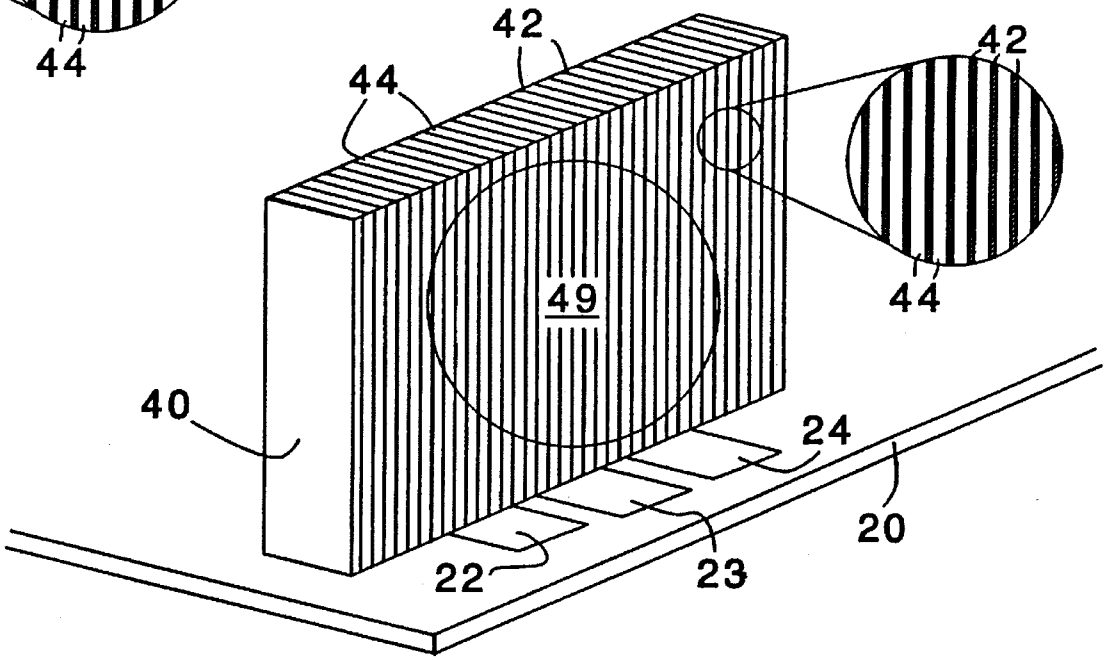
FIG. 3 is an enlarged perspective view of the elastomeric pad in operative association with the printed circuit board. This figure further illustrates the contact redundancy between the elastomeric pad and printed circuit board traces.

FIG. 3 illustrates a sample elastomeric pad 40 in operative association with traces 22, 23, 24 on the printed circuit board 20. The dimensions and specifications of both the elastomeric pad 40 and traces 22, 23, 24 are such that there should exist significant redundancy of contacts between the elastomeric pad 40 and the traces 22, 23, 24 on the printed circuit board 20. The traces 22, 23, 24 can be located on one or more printed circuit boards 20 and are, e.g. gold traces.

Figure 4:
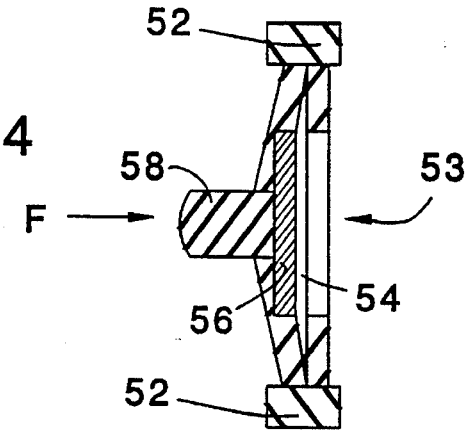
FIG. 4 is a cross sectional view of the moveable connector. The arrangement of the moveable connector, as shown in the figure, is particularly adapted for exposing the conductive contact in response to an externally force, F, applied to the shell.

FIG. 4 is a cross sectional view of the moveable connector 50 which illustrates the arrangement of the conductive contact 56 within the flexural diaphragm shell 52. The preferred moveable connector 50 is similar to a dome keypad type contact often used on pushbutton switches or keyboard switches. The moveable connector 50 specifically comprises: a flexural diaphragm shell 52 which defines an opening 53 leading to an interior cavity 54; a conductive contact 56 disposed within the interior cavity 54; and a plunger means 58 which is contained within the shell 52 and adapted for exposing the conductive contact 56 proximate the opening 53 in response to an externally applied force. The moveable connector 50 is particularly adapted for receiving an externally applied force such as striking a pushbutton pad, keypad, or touchpad on a calculator, phone, or remote control device, or other small electronic device. The externally applied force is preferably directed to the shell 52 and the underlying plunger means 58.

FIG. **5*a* and 5*b* are cross sectional views of the preferred moveable contact 30, elastomeric pad 40 and housing 30 shown in operative association. The proper alignment and orientation of the elements of the elastomeric switch 10 is maintained by the structural and mechanical features of the housing 30 such that the elastomeric pad 40 is forcibly maintained in contact with the traces, i.e. trace 23, on the circuit board. The housing 30 is also adapted for aligning the elastomeric pad 40 in close proximity to the conductive contact 56 within the moveable connector 50. The actual design of the housing 30 will depend on the physical dimensions of the elastomeric pad 40, and the moveable connector 50** as well as the physical constraints of the application.

Figure 5A:
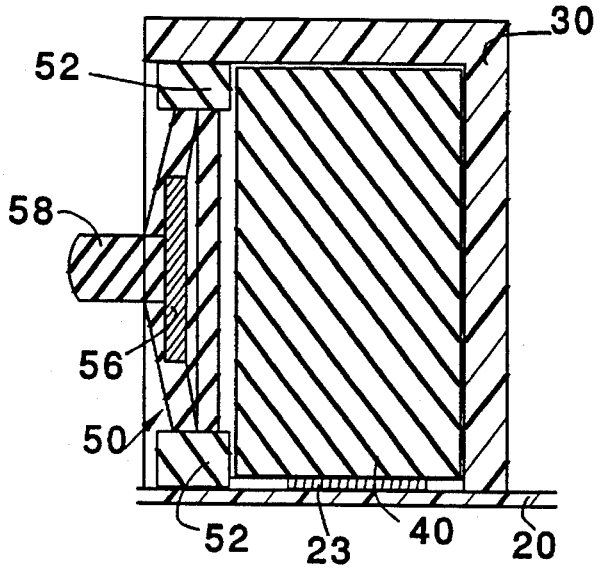
FIGS. 5*a* and 5*b* are cross sectional views of the moveable connector, elastomeric pad and housing in operative association.
Figure 5B:
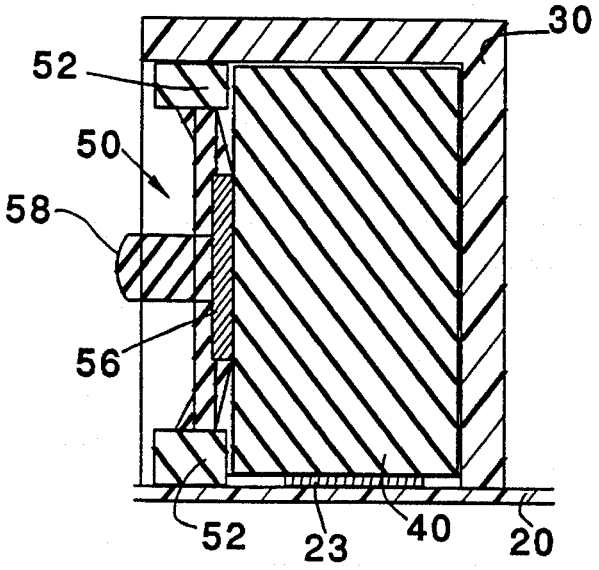

The operation of the preferred embodiment of the elastomeric switch 10 can be easily understood by referring back to FIG. 1, FIG. 5*a* and FIG. 5*b*. Specifically, FIG. 5*a* illustrates the elastomeric switch in an open condition with the moveable connector in a nonconductive position with respect to the elastomeric pad. In response to an external force, the conductive contact 56 within the moveable connector 50 is directed towards the elastomeric pad 40. This action causes the conductive contact 56 to be placed in actual contact with the elastomeric pad 40. FIG. 5*b* illustrates the elastomeric switch in a closed condition with the moveable connector establishing an electrically conductive connection across the elastomeric pad. The actual contact between the conductive contact 56 and the elastomeric pad 40 creates a direct connection between a plurality of the exposed parallel conductive strips 42 within the target area 49 on the elastomeric pad 40. These same parallel conductive strips 42 are also in direct contact with the traces 22, 23, 24 on the printed circuit board 20 thereby producing a connection between the traces 22, 23, 24 and the corresponding circuits. This embodiment generally involves the elastomeric switch 10 operating in an on/off or connect/disconnect mode.

An alternative embodiment would involve the lateral movement of the moveable connector across the elastomeric pad. For purposes of this invention, lateral movement is generally representative of that direction which is orthogonal to the parallel conductive strips in the elastomeric pad. In this embodiment the moveable connector is initially placed in contact with the elastomeric pad thus establishing a connection, for example, between a first trace and a second trace. In response to an external force, the conductive contact within the moveable connector is moved in a lateral direction thus breaking the connection between first trace and second trace, and establishing a connection between the second trace and a third trace thereby producing a connection of the corresponding circuits. This embodiment involves the elastomeric switch operating in a continuous transfer mode.

The present invention and many of its attendant advantages will be understood from the foregoing description, and it will be apparent that various changes may be made in the form, construction and arrangement of the parts thereof without departing from the spirit and scope of the invention or sacrificing all of its material advantages, the forms hereinbefore described being merely exemplary embodiments thereof.

To that end, it is not intended that the scope of the invention be limited to the specific embodiments illustrated and described. Rather, it is intended that the scope of this invention be determined by the appending claims and their equivalents.

What is claimed is:

1. An elastomeric switch for connecting, disconnecting and transferring a current between a plurality of traces on printed circuit board in an electronic device, the elastomeric switch comprising:

a housing disposed on the printed circuit board and proximate the plurality of traces;

an elastomeric pad disposed within the housing and further disposed in contact with the plurality of traces;

a flexural diaphragm shell operatively associated with the housing, the flexural diaphragm shell having an opening leading to an interior cavity;

a conductive element disposed within the interior cavity and aligned with the elastomeric pad via the opening; and a plunger means for moving the conductive element in direct contact with the elastomeric pad such that the conductive element establishes an electrical connection between the traces via the elastomeric pad in response to an externally applied force to the plunger means.

2. The elastomeric switch of claim 1 wherein the elastomeric pad further comprises:

a plurality of parallel strips of conductive material disposed between layers of non-conductive elastomeric material; and the elastomeric pad is further disposed such that a plurality of the parallel conductive strips are aligned in direct contact with each of the traces.

3. The elastomeric switch of claim 2 wherein the parallel strips of conductive material are silicone material which has been impregnated with a conductive particles.

4. The elastomeric switch of claim 3 wherein the conductive particles are selected from the group consisting of carbon or silver flakes.

5. The elastomeric switch of claim 2 wherein the parallel strips of conductive material disposed between layers of non-conductive elastomeric material further comprise a non-conductive silicone base with parallel paths of conductive metal deposited thereon.

6. The elastomeric switch of claim 5 wherein the deposited conductive metals include one or more of the metals selected from the group consisting of nickel, copper, or gold.

7. The elastomeric switch of claim 2 wherein the non-conductive elastomeric material is silicone rubber.

8. The elastomeric switch of claim 2 wherein the parallel strips of conductive material disposed between layers of non-conductive elastomeric material are externally exposed on at least two surfaces of the elastomeric pad.

9. The elastomeric switch of claim 2 wherein the parallel strips of conductive material disposed between layers of non-conductive elastomeric material are externally exposed on two adjacent surfaces of the elastomeric pad.

10. The elastomeric switch of claim 2 wherein the parallel strips of conductive material disposed between layers of non-conductive elastomeric material are externally exposed on two opposite surfaces of the elastomeric pad.

11. The elastomeric switch of claim 1 wherein the conductive element is a carbon contact.

12. The elastomeric switch of claim 1 wherein the housing further maintains the proper alignment and orientation of the elastomeric pad and moveable conductive contact relative to the traces.

13. The elastomeric switch of claim 1 wherein the traces on the printed circuit board are gold traces.

14. An elastomeric switch for connecting, disconnecting and transferring a current between a plurality of traces on a printed circuit board in an electronic device, the elastomeric switch comprising:

a housing disposed on the printed circuit board and proximate the plurality of traces;

an elastomeric pad containing a plurality of parallel strips of conductive material disposed between layers of non-conductive elastomeric material, the elastomeric pad disposed such that a plurality of the parallel conductive strips are aligned in direct contact with each of the traces;

a deformable shell operatively associated with the housing, the deformable shell having an opening leading to an interior cavity;

a conductive element disposed within the interior cavity and aligned with the elastomeric pad via the opening; and a plunger means for moving the conductive element in direct contact with the elastomeric pad such that the conductive element establishes an electrical connection between the traces via the elastomeric pad in response to an externally applied force to the plunger means.

15. The elastomeric switch of claim 14 wherein the parallel strips of conductive material are silicone material which has been impregnated with a conductive particles selected from the group consisting of carbon or silver flakes.

16. The elastomeric switch of claim 14 wherein the parallel strips of conductive material disposed between layers of non-conductive elastomeric material further comprise a non-conductive silicone base with parallel paths of conductive metals deposited thereon wherein the deposited conductive metals include one or more of the metals selected from the group consisting of nickel, copper, or gold.

17. The elastomeric switch of claim 14 wherein the non-conductive elastomeric material is silicone rubber.

18. The elastomeric switch of claim 14 wherein the parallel strips of conductive material disposed between layers of non-conductive elastomeric material are externally exposed on at least two surfaces of the elastomeric pad.

* * * * *